US006311742B1

(12) United States Patent
Nusen et al.

(10) Patent No.: US 6,311,742 B1
(45) Date of Patent: Nov. 6, 2001

(54) FUEL DISPENSING NOZZLE WITH ANTI-DRIP VALVE AND VENTURI LOCATED IN DOWNSTREAM END OF THE NOZZLE

(75) Inventors: Andreas Jacobus Louis Nusen; Leonardus Henricus Wilhelmus Giesen, both of Enschede (NL)

(73) Assignee: OPW Fueling Components Europe B.V. (NL)

( * ) Notice: Subject to any disclaimer, the term of this patent is extended or adjusted under 35 U.S.C. 154(b) by 0 days.

(21) Appl. No.: 09/486,568

(22) PCT Filed: Sep. 1, 1998

(86) PCT No.: PCT/NL98/00494

§ 371 Date: Jan. 5, 2000

§ 102(e) Date: Jan. 5, 2000

(87) PCT Pub. No.: WO99/11566

PCT Pub. Date: Mar. 11, 1999

(30) Foreign Application Priority Data

Sep. 1, 1997 (NL) ..... 1006898

(51) Int. Cl.[7] ..... B65B 1/30; B65B 3/28; B65B 57/06; B65B 57/14; B67C 3/00

(52) U.S. Cl. ..... 141/206; 141/311 A; 141/198; 141/285; 141/301; 141/302; 141/308

(58) Field of Search ..... 141/59, 311 A, 141/206, 208, 209, 285, 301, 302, 308, 309, 311 R, 382, 198

(56) References Cited

U.S. PATENT DOCUMENTS

| | | | | |
|---|---|---|---|---|
| 3,994,323 | * | 11/1976 | Takahata et al. | 141/302 |
| 4,214,614 | * | 7/1980 | Pyle | 141/1 |
| 4,809,753 | * | 3/1989 | Fink, Jr. | 141/206 |
| 4,984,612 | | 1/1991 | de la Haye . | |
| 5,603,364 | * | 2/1997 | Kerssies | 141/392 |

FOREIGN PATENT DOCUMENTS

| | | |
|---|---|---|
| 1072902 | 3/1958 | (DE) . |
| 8616765 | 6/1986 | (DE) . |
| 0337871 | 11/1989 | (EP) . |

* cited by examiner

*Primary Examiner*—Timothy L. Maust
(74) *Attorney, Agent, or Firm*—Dinsmore & Shohl LLP

(57) ABSTRACT

A fluid dispensing nozzle which is connectable to a fluid reservoir for filling a tank with fuel. The nozzle is provided with a through-flow channel in fluid communication with a spout and with a trigger for operating at least one valve in the through-flow channel for opening and/or closing the through-flow channel. The spout is provided with an output end for delivering fuel and the fuel dispensing nozzle further comprises: an end valve which is movable between an open situation, wherein the end valve opens a through-flow opening for the fuel in the spout, and a closed situation wherein the end valve closes the spout; and a venturi for co-action with level detection means for detecting the fluid level in the tank. The end valve and the venturi are substantially arranged in the downstream end of the spout.

24 Claims, 13 Drawing Sheets

5
51
52
53
54
55
56
57
59
60
66
67
68
70
71
72
73
74
75

FUEL DISPENSING NOZZLE WITH ANTI-DRIP VALVE AND VENTURI LOCATED IN DOWNSTREAM END OF THE NOZZLE

FIELD OF THE INVENTION

The invention relates to a fluid dispensing nozzle which is connectable to a fluid reservoir for filling a tank with fluid, which fluid dispensing nozzle is provided with a through-flow channel for the fluid which debouches into a spout and with a trigger for operating at least one valve in the through-flow channel for opening and/or closing the through-flow channel, wherein the spout is provided with an output end for delivering fluid, which fluid dispensing nozzle further comprises:

an end valve which is movable between an open position, in which the end valve opens a through-flow opening for the fluid in the spout, and a closed position in which the end valve closes the spout; and a venturi for co-action with level detection means for detecting the fluid level in the tank.

BACKGROUND OF THE INVENTION

Such a fluid dispensing nozzle is known in the form of a nozzle for filling with fuel. In the known nozzle the venturi is placed high in the spout close to the connection between the spout and the body of the nozzle. The end valve is situated close to the output end of the spout. The known nozzle has the drawback that due to air being drawn in by the venturi a mixture of air and fuel is present in the spout. This results in the following problems. Firstly, the volume of the fluid present between the end valve and the main valve, which is situated in the body of the nozzle, is not guaranteed, which is contrary to the requirements imposed by the weights and measures inspection. Furthermore, the air can expand under the influence of particular ambient conditions in the spout, whereby pressure is exerted on different components of the nozzle, which can result in leakage of for instance valves or seals.

SUMMARY OF THE INVENTION

The invention has for its object to provide a fluid dispensing nozzle of the type referred to in the preamble which obviates these drawbacks.

For this purpose the fluid dispensing nozzle according to the invention has the feature that the end valve and the venturi are substantially arranged in the half of the spout provided with the output end. In the fluid dispensing nozzle according to the invention the position of the end valve moreover ensures that the fluid dispensing nozzle does not drip after use. The invention also has the advantage that by placing a combined end valve/venturi the total drop in pressure over the fluid dispensing nozzle remains as limited as possible, since there is now only one constriction for the fluid as a result of the combined end valve/venturi instead of two constrictions resulting from a separate end valve and venturi.

In a first preferred embodiment the end valve and the venturi are arranged close to the output end of the spout. The form of the end valve is preferably such that, in co-action with the seat thereof and/or with the inner wall of the spout located close by, the end valve forms the venturi.

In a further preferred embodiment the end valve is movable counter to the action of spring means from the closed to the open position in the direction of the output end, wherein the spring means have an at least partially degressive spring characteristic. The use of degressive spring means achieves that a good operation of the venturi is also ensured when small amounts of fluid are delivered. This moreover achieves that when the fluid delivery stops the end valve is pulled with force into its closed position by the spring means, whereby a good sealing is obtained.

In an alternative preferred embodiment the spout is provided with a separate channel for the fluid which runs along the end valve and forms part of the venturi. The venturi channel is preferably formed at least partially by a recess in the outer wall of the end valve. In a further preferred embodiment the venturi channel is formed at least partially by a pipe-like part fixed to the end valve. All the above stated measures contribute towards a smooth fluid flow which is distributed evenly over the through-flow channel. The fluid therefore flows in a predominantly straight jet out of the fluid dispensing nozzle.

In another preferred embodiment a closing body is received in the venturi channel. Undesirable leakage of fluid out of the venturi channel is hereby prevented. Biasing means are preferably provided in the venturi channel for biasing the closing body in the direction opposed to the fluid flow. The biasing means are more preferably adapted such that during operation of the fluid dispensing nozzle the venturi channel opens sooner than the through-flow opening of the spout closed by the end valve. This preferred embodiment achieves that the venturi channel opens only at a certain pressure. This pressure can be adjusted using the bias such that a full tank can be detected in good time, i.e. before the end valve opens.

In a further preferred embodiment the venturi channel widens in the direction of the output end. The venturi channel is preferably at least partially cone-shaped. The section of the venturi channel is more preferably at least partially banana-shaped. Experiments show that these forms of venturi channel contribute to the smooth flow of the fluid. With such a venturi channel the limited space in the spout is moreover utilized economically. This advantage is enhanced still further in combination with the following preferred embodiment in which the center line through the end valve rod lies in one or more positions of the end valve at an angle $\alpha>0$ to the center line through the spout.

In another preferred embodiment the fluid dispensing nozzle comprises level detection means for detecting the fluid level in the tank, which level detection means comprise a level detection channel which runs substantially parallel to the through-flow channel, wherein a closing body is received in the level detection channel for closing the level detection channel when fluid is detected. The closing body is preferably adapted to be carried along by fluid flow to an upstream position in which the closing body substantially closes the level detection channel. The closing body is more preferably ball-shaped. The level detection means detect in known manner suction of fluid into the level detection channel. In the described embodiment the sucked-in fluid will carry the closing body to a position where it closes a part of the level detection channel located upstream. The sucking-in of gas alone is insufficient for this purpose. The closure results in an abrupt pressure difference which can be detected in simple manner and sets the switch-off mechanism of the nozzle into operation in reliable manner.

BRIEF DESCRIPTION OF THE DRAWINGS

The invention will now be described in more detail with reference to the drawings, in which.

DETAILED DESCRIPTION

Figure 1:
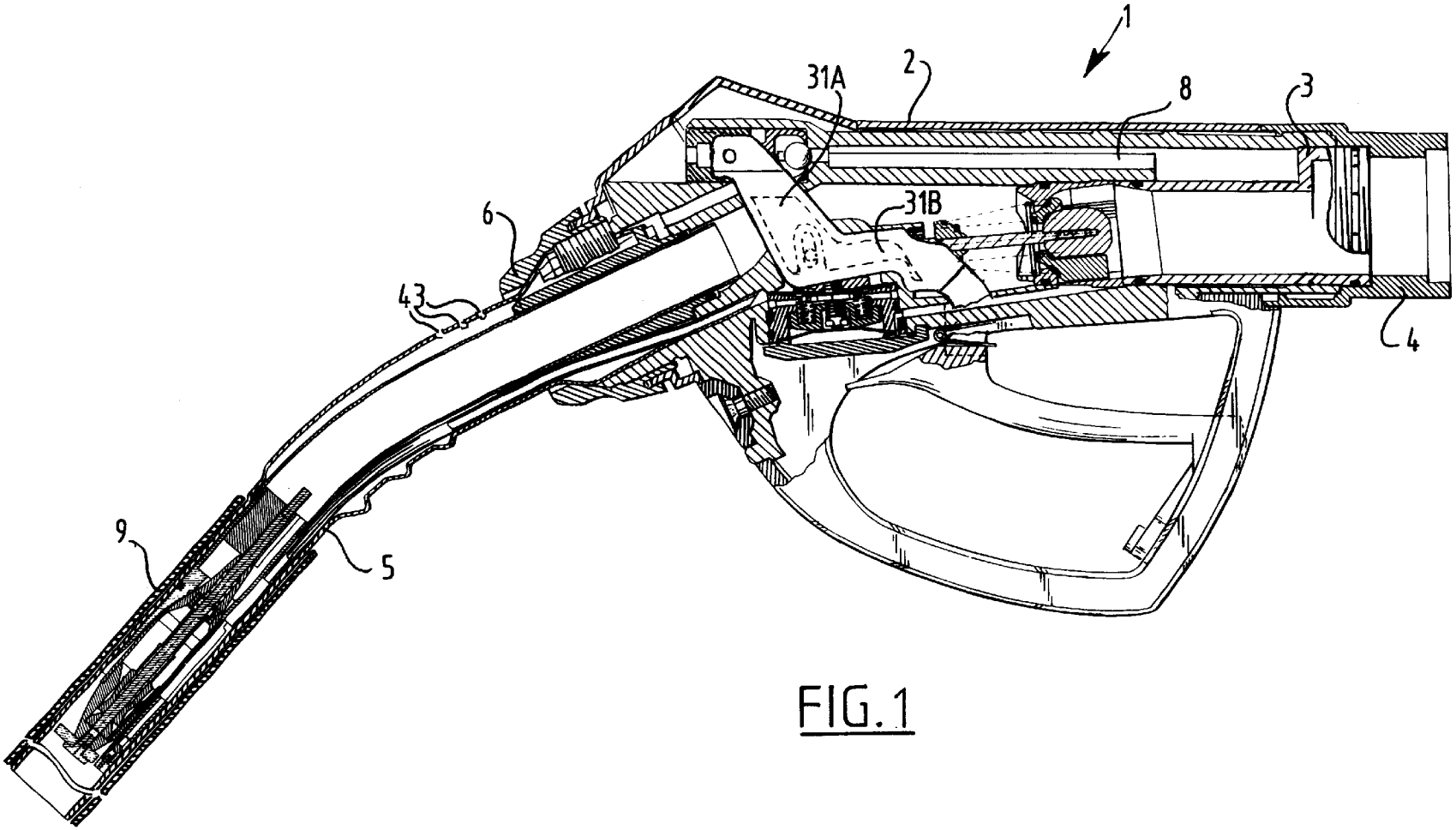
FIG. 1 shows a cross-sectional view of a modular filling nozzle according to the invention in a first embodiment.
Figure 2:
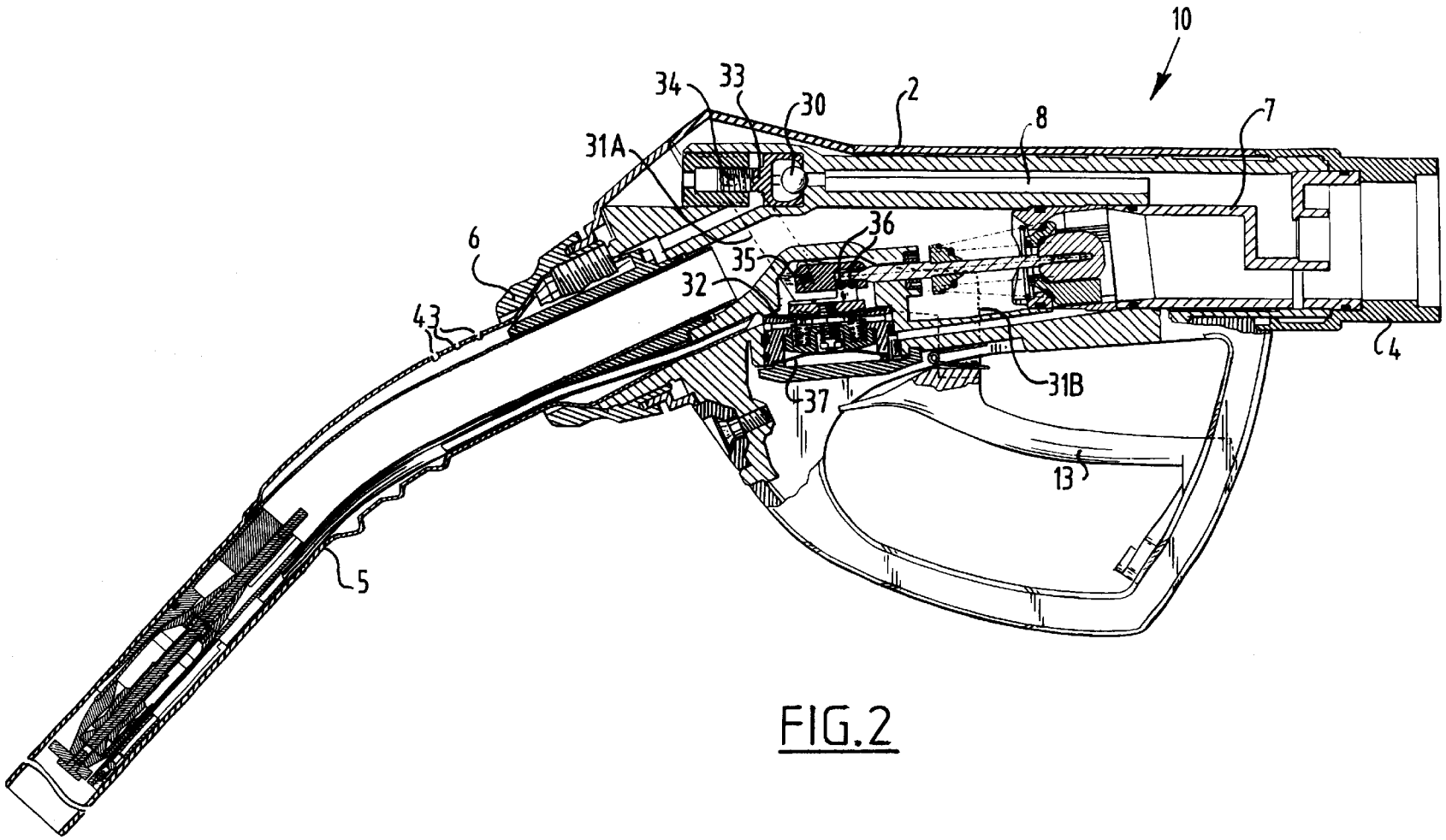
FIG. 2 shows a cross-sectional view of the modular filling nozzle according to the invention in a second embodiment.

FIG. 1 shows as an example of a fluid dispensing nozzle according to the invention a cross-sectional view of a modular fuel nozzle in a first embodiment designated with 1. FIG. 2 shows an alternative embodiment of the nozzle designated with 10.

Nozzle 1 comprises a basic module 2 on which one or more further modules can be releasably mounted. The set of further modules contains for instance a closing module 3, a passage module 7, a spout 5 and/or an adapter sleeve 9. In the-case of nozzle 1 or 10 nut 4 can be unscrewed, whereafter closing module 3 or passage module 7 can be pushed as desired into the basic module.

FIG. 2 nozzle 10 is provided with passage module 7. This latter connects vapor return channel 8 to the hose of the fuel pump (not shown) to which the nozzle is connected. Evaporated fuel can hereby be recovered during filling. Conversely, closing module 3 of FIG. 1 closes the vapor return channel. In nozzle 1 no vapor recovery is possible. Spout 5 can likewise be mounted releasably onto basic module 2 by means of nut 6. A spout of suitable diameter can be added in simple manner to the basic module. Alternatively, spout 5 can be embodied with a narrower diameter so that it is suitable in particular for use with fuel tanks of vehicles running on unleaded gasoline. By placing an adapter sleeve 9 on spout 5 this latter can be made suitable for fuel tanks of vehicles running on, leaded gasoline or diesel, or unsuitable for fuel tanks of vehicles running on unleaded gasoline.

Nozzle 1 is suitable in the shown embodiment for filling with diesel. Nozzle 1 can also be used for filling with leaded gasoline without applying vapor recovery. Nozzle 10 is suitable in the shown embodiment for filling with unleaded gasoline.

The set of modules also comprises a display module (not shown) which is fixed for instance to the basic module, for displaying information such as advertising messages.

Figure 3:
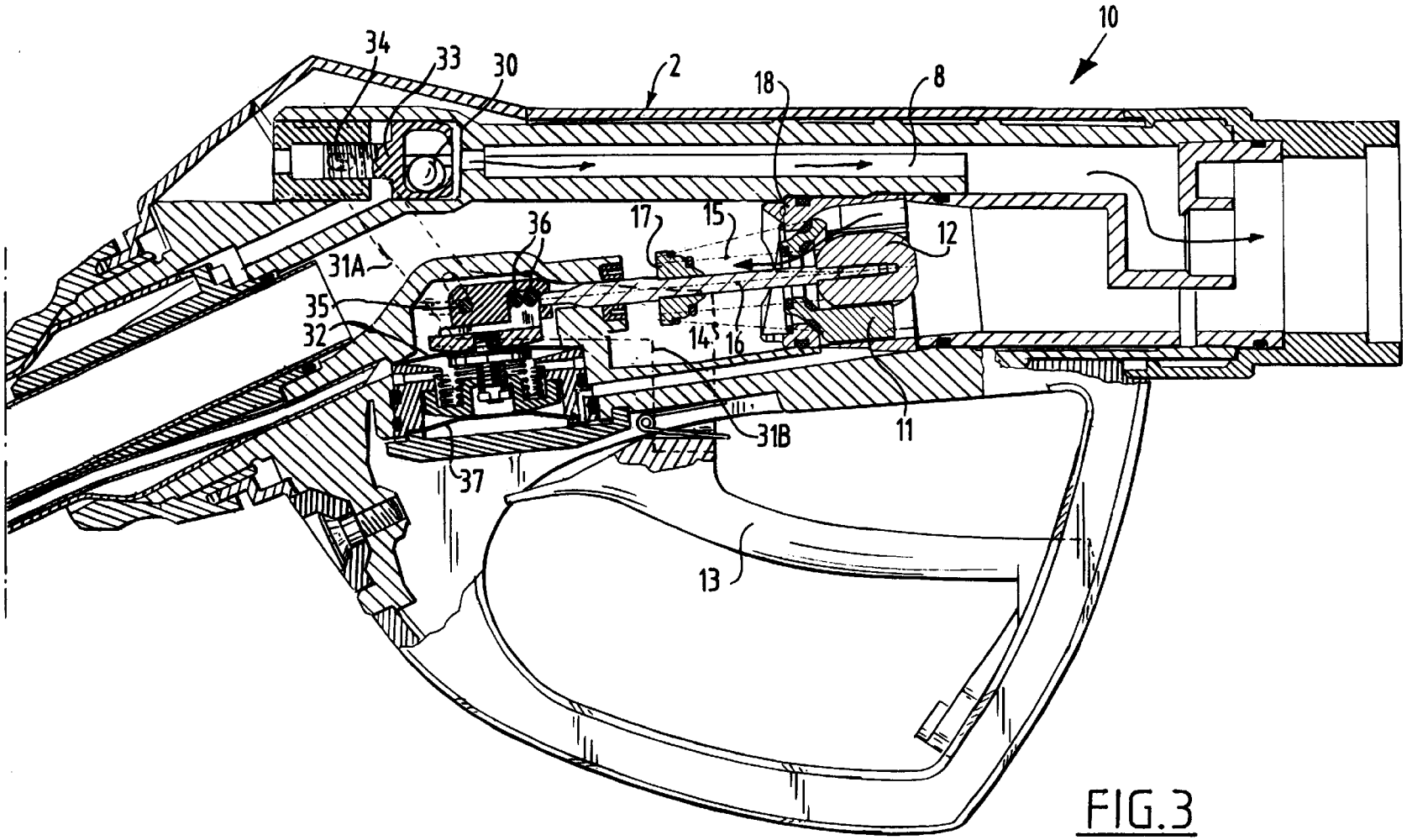
FIG. 3 shows the basic module of the filling nozzle in more detail with the opened auxiliary valve.

FIG. 3 shows the basic module of the nozzle in more detail. Main valve 11 opens a main through-flow opening for the fuel. Received in main valve 11 is an auxiliary valve 12 which opens an auxiliary through-flow opening for the fuel. Auxiliary valve 12 is coupled to rod 16 which runs through the main valve and is movable therein. Rod 16 is coupled for movement to trigger 13. Rod 16 is provided with a stop 17 against which rest first biasing means 14 and second biasing means 15. Biasing means 14 and 15 are spring means. First biasing means 14 engage on the other side thereof on the seat 18 of main valve 11. Second biasing means 15 engage on the other side thereof on the main valve 11 itself.

Figure 4:
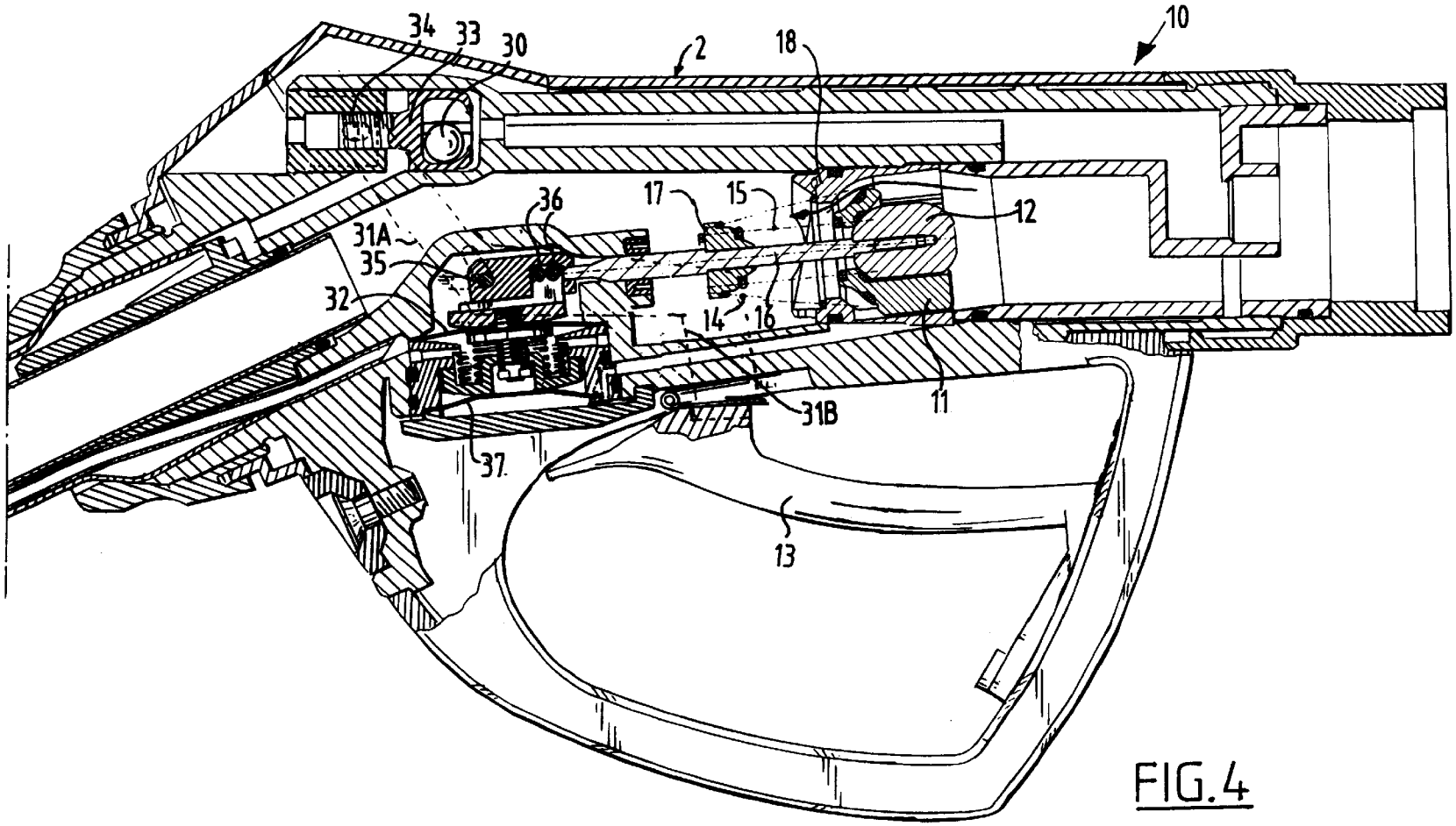
FIG. 4 shows the basic module with opened main valve.
Figure 5:
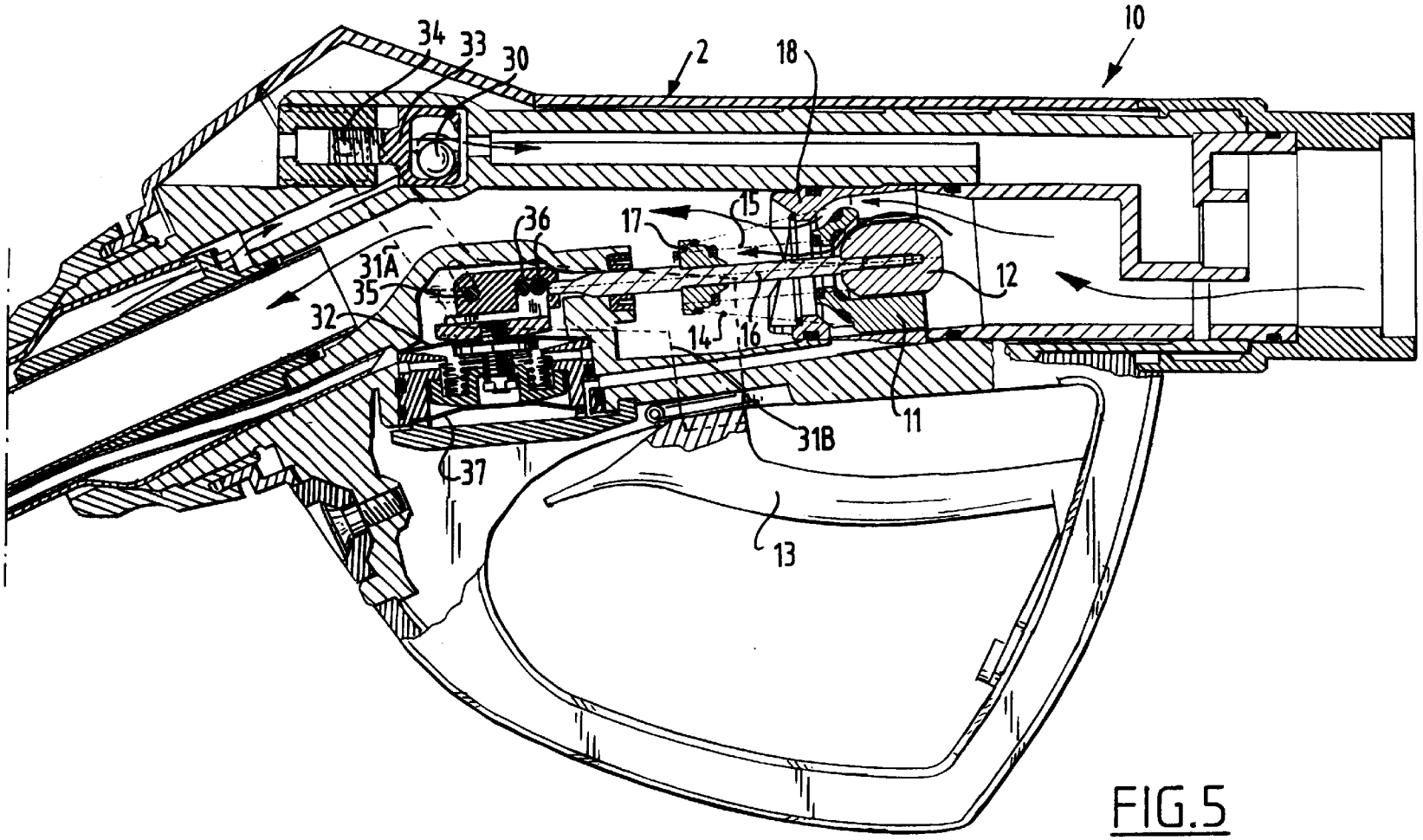
FIG. 5 shows the basic module with opened auxiliary and main valve.

The operation of the nozzle is as follows. By exerting a relatively small force on handle 13 the user opens auxiliary valve 12 through movement of rod 16. This opened position of the auxiliary valve is shown in FIG. 3. During movement of rod 16 first and second biasing means 14 and 15 are biased. The quantity of fuel which flows through the auxiliary through-flow opening preferably lies in the range of 10 to 50% of the maximum fuel flow through the nozzle. The dimensions of the auxiliary through-flow opening the main through-flow opening are more preferably such that approximately 25% of the maximum fuel flows through the auxiliary through-flow opening. When handle 13 is squeezed further inward by the user, the force exerted by the second biasing means 15 on main valve 11 becomes greater at a given moment than the force exerted by the fuel on the main valve. The main valve then opens automatically counter to the direction of flow. This opened position of the main valve is shown in FIG. 4. By squeezing handle 13 still further inward, auxiliary valve 12 can be moved from its now closed position to its open position. This position is shown in FIG. 5. The fuel flow rate is now maximal.

Figure 6:
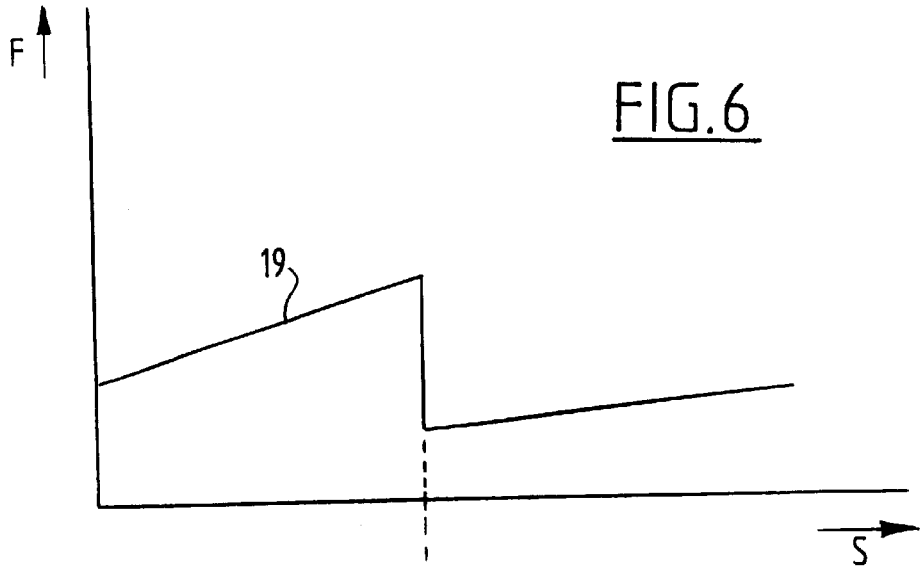
FIG. 6 shows a graph in which the required force to be exerted by a user is plotted schematically against the stroke of the valve rod.
Figure 7:
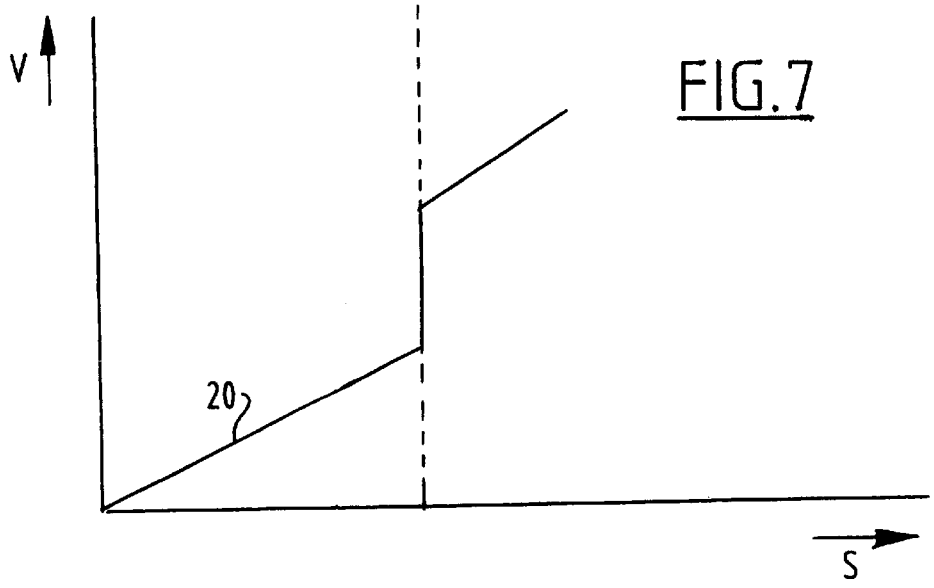
FIG. 7 is a graph which shows schematically the fuel flow plotted against the stroke of the valve rod.

FIG. 6 shows a graph in which line 19 schematically represents the force F which must be exerted by a user on the trigger plotted against the stroke S of rod 16. FIG. 7 shows a graph in which line 20 schematically represents the fuel flow V plotted against the stroke of valve rod 16. The transition point in both graphs is caused by springing open of the main valve. It can be seen clearly that the force to be exerted remains within certain limits over the whole range of the stroke. At both a low fuel flow and at a high fuel flow the user can suffice with a relatively low actuating force. The convenience of operation of the nozzle according to the invention is thereby improved considerably relative to that of the known nozzle.

As already stated above, the nozzle according to the invention is adapted to suck up evaporated fuel during filling. Spout 5 is provided as standard for this purpose with suction apertures 43 for sucking in evaporated fuel. The operation of this vapor suction system can best be understood with reference to FIGS. 2 and 3. These figures show that vapor return channel 8 can be closed using a ball-like closure body 30. Ball 30 is arranged in a claw 33 which is placed shiftably in the line of vapor return channel 8. Trigger 13 is coupled on one side thereof to lever 31 which in turn is coupled rotatably to claw member 33 via rotation point 34. Lever 31 consists of two arms 31A and 31B which are mutually connected at connecting point 35. Point 35 can function as a rotation point depending on the position of detection means in the form of membrane 32 and of spacer elements in the form of rollers or rods 36. Point 35 is placed displaceably in the line of rod 16. It is noted that lever arms 31A and 31B are shown in FIG. 1 but in FIGS. 2–5 and 12 they are only shown schematically with broken lines.

The operation of the vapor suction system according to the invention is as follows. In FIG. 2 the nozzle 10 is ready for use and all movable parts are situated in the rest position. Ball 30 closes vapor return channel 8. Membrane 32 is also situated in the rest position. This is also the case for rollers 36. Rotation point 35 has no fixed position, so that when trigger 13 is squeezed lever 31 can rotate freely on rotation point 34. No shifting of claw member 33 herein takes place and ball 30 remains in the shown position, so that vapor return channel remains closed.

As soon as the fuel pump is started, for instance because a user takes nozzle 10 out of the holder, membrane 37 and, as a result thereof membrane 32, moves from the rest position to the operating position under the influence of the fuel pressure. This operating position is shown in FIG. 3. This has the consequence that rollers 36 also move from the rest position to the operating position, wherein they lie against rod 16 and thereby support rotation point 35 on rod 16. By squeezing trigger 13 rotation point 34 will shift to the position shown in FIG. 3. Claw member 33 herein pulls ball 30 from its position, so that vapor return channel 8 is opened. The distance through which rotation point 34 can be shifted is adjusted using a stop (not shown). This adjustable stop determines the stroke of the trigger, and consequently the maximum fluid flow rate of the main valve.

By now exerting more force on trigger 13, rod 16 will then be moved via rotation point 35 to the right in FIG. 3, whereby auxiliary valve 12 and main valve 11 will be successively opened.

When the fuel pump is switched off and the pressure falls away, membrane 37 and, as a result thereof membrane 32, will return from the operating position to the rest position. This also applies for rollers 36. Rod 16 will consequently move to the left in FIG. 3, whereby the auxiliary valve and/or the main valve are closed. A reliable switch-off mechanism is thus realized.

Closure of the vapor return channel is moreover position-dependent. When the nozzle is hung in the holder of the pump, ball 30 will close the vapor return channel.

Figure 8:
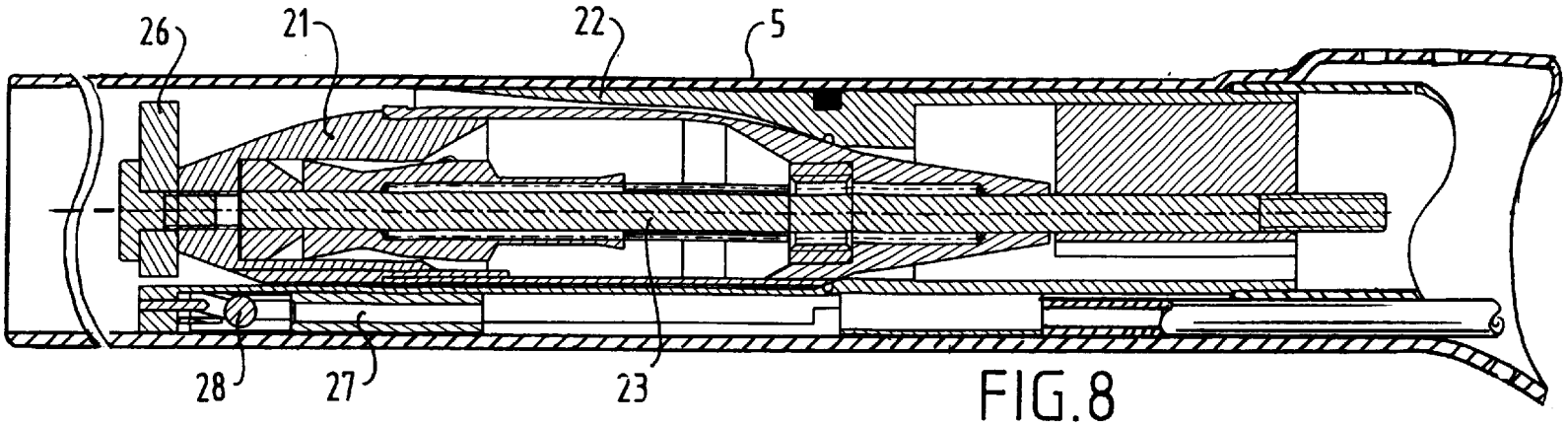
FIG. 8 is a detailed side cross-sectional view of the end valve of the filling nozzle according to the invention in the first, closed position.
Figure 9:
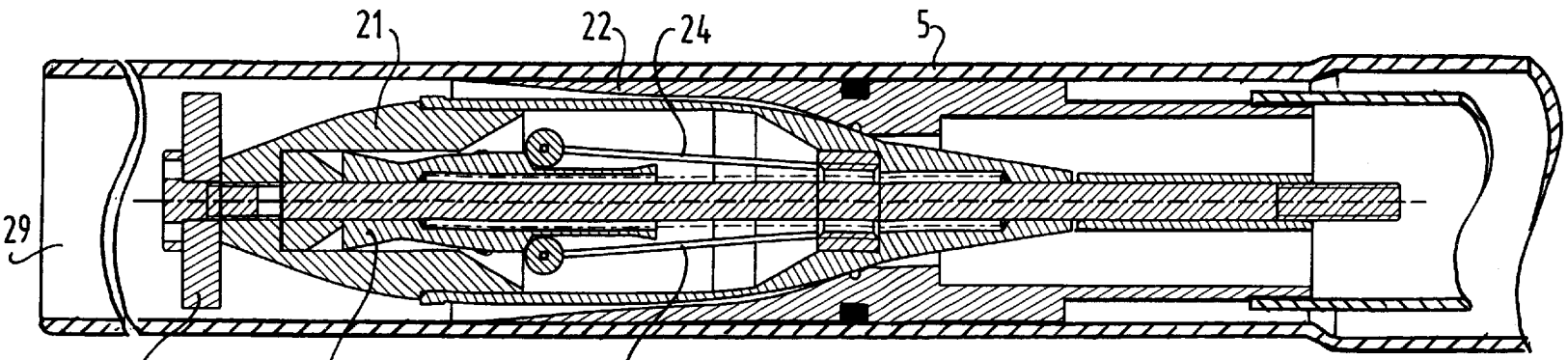
FIG. 9 shows the end valve of FIG. 8 in top cross-sectional view.

FIG. 8 shows a detailed side cross-sectional view of the end valve of the nozzle according to the invention. FIG. 9 shows the end valve of FIG. 8 in top cross-sectional view. End valve 21 takes a form such that, in co-action with the inner wall of spout 5 and seat 22 of the end valve, it forms part of a venturi. Underpressure is created by the venturi subject to the quantity of outflowing fuel. The venturi co-acts with the switch-off mechanism, this being elucidated hereinbelow. The shape of end valve 21 is substantially conical. This shape tapers approximately conically from the middle of the end valve to the outer ends thereof. End valve 21 is arranged movably on shaft 23. Spring means 24 are arranged in end valve 21. These spring means rest against a stop 25 which is fixed on shaft 23. As seen in the flow direction of the fuel, a baffle element 26 is situated at the rear which, in the closed situation of end valve 21, closes the opening 29 of the delivery end of spout 5. Body 26 reduces turbulence in the fuel flow as much as possible and, due to the shape thereof, supports opening of the end valve under the influence of the fluid flow.

Figure 10:
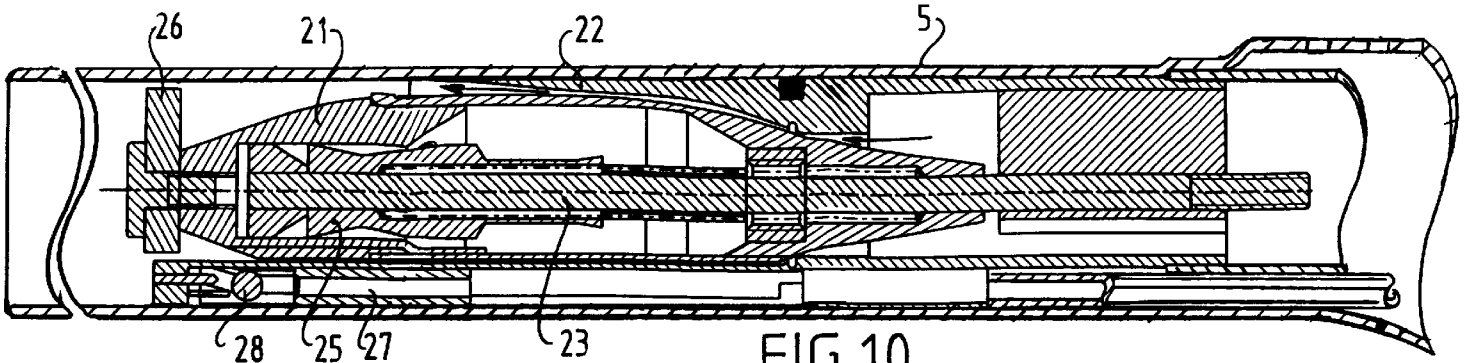
FIG. 10 shows the end valve of FIG. 9 in the second, open position.
Figure 11:
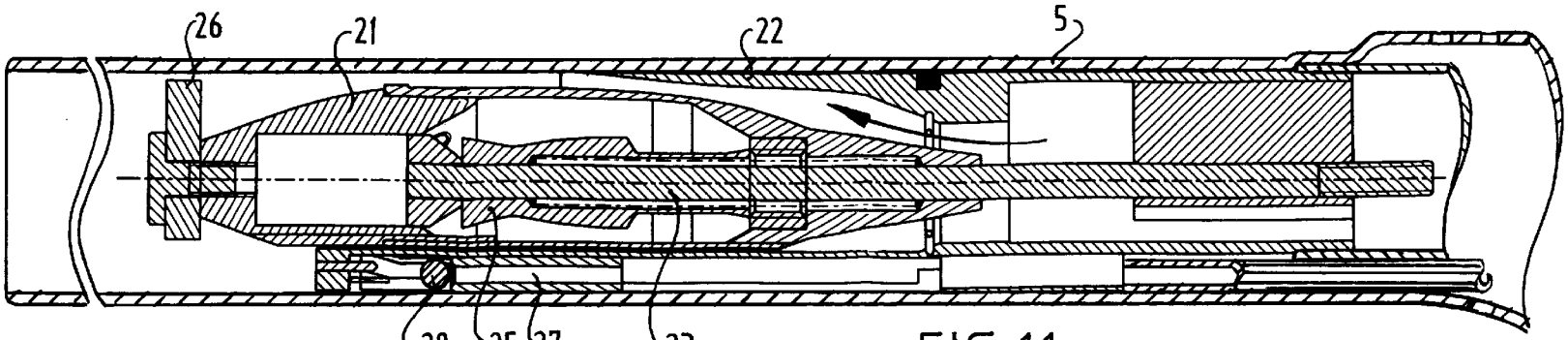
FIG. 11 shows the end valve in the third, open position.

FIGS. 8 and 9 the end valve 21 is shown in its closed position. When during use fuel flows through the nozzle in the direction of the delivery end, end valve 21 moves counter to the action of spring means 24 toward opening 29 under the pressure of the fuel. End valve 21 is then situated in the position shown in FIG. 10. At a low fuel flow rate there will be a high through-flow speed in the narrow opening between seat 22 and end valve 21, which provides a good venturi action. Spring means 24 contribute herein that they have a degressive spring characteristic, at least when the end valve has a small stroke. The spring characteristic of spring means 24 is preferably progressive as the stroke of end valve 21 increases. FIG. 11 shows the extreme position of end valve 21 in which it is fully opened at a maximum fuel flow rate. The use of controllable, degressive spring means achieves that, when small quantities of fluid are delivered, a good action of the venturi is also ensured through the narrow opening between seat 22 and end valve 21 (shown in FIG. 10).

The nozzle according to the invention is provided with level detection means for detecting the fuel level in the tank for filling. These level detection means comprise a level detection channel 27 which runs substantially parallel to the through-flow channel, and thereby to the wall of the spout. Level detection channel 27 is connected via membrane 32 and the above described switch-off mechanism to the venturi for sucking up a fluid from the tank of the vehicle during filling. When filling starts, the fluid consists predominantly of fuel vapor mixed with air. However, when this tank is full, fuel will be drawn into the level detection channel. This fuel carries ball-like closing body 28 along to a position in which this closing body closes the part of level detection channel 27 located further upstream. An abrupt pressure difference is herein effected in the level detection channel. Membrane 32 will hereby move from the operating position (FIG. 3) to the rest position (FIG. 2) and, in a manner corresponding with that described above, trigger the switch-off mechanism so that the auxiliary and/or main valve is closed. The switch-off mechanism for the main valve is also set into operation when the fluid dispensing nozzle is moved in upward direction from an almost horizontal position of output opening 29. Ball 28 then rolls to the position wherein it closes level detection channel 27. The main valve is closed in a manner analogous to that described above. The level of position detection means of the nozzle according to the invention operate in reliable manner through use of the closing body. Undesired switch-off of the nozzle caused by fuel splashes entering the level detection channel is avoided in the nozzle according to the invention.

Figure 12:
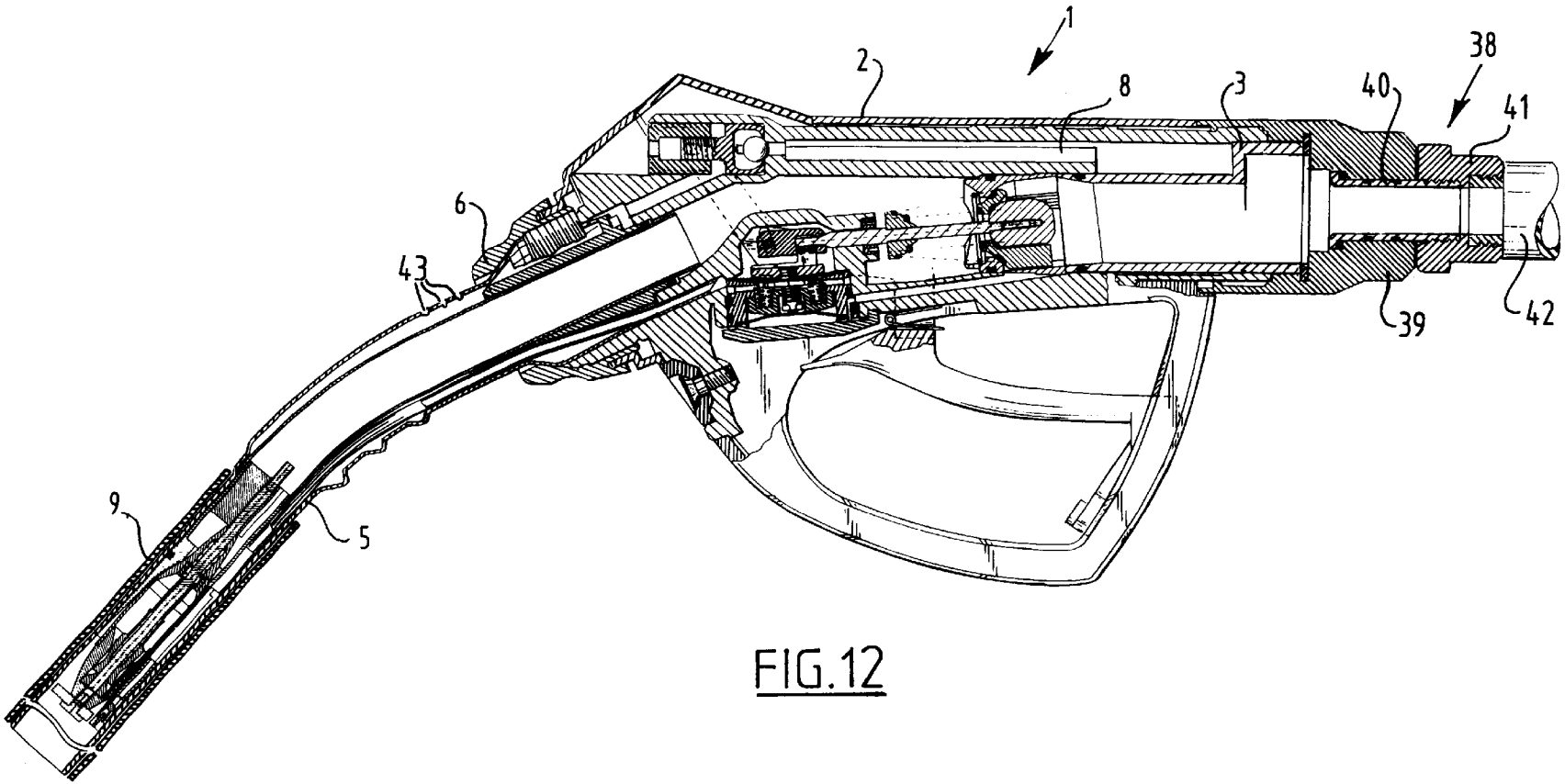
FIG. 12 shows the filling nozzle with hose connecting module.

FIG. 12 shows the modular nozzle 1 according to the invention provided with a hose connecting module 38. This latter is arranged on nozzle 1 instead of the nut 4 shown in FIG. 1. Hose connecting module 38 consists of an adapter 39, a nut 41 and sleeve 40. Adapter 39 is fixed on basic module 2. Nut 41 serves for connection of a hose 42 onto basic module 2 via adapter 39. Extending in adapter 39 and nut 41 is a sleeve 40 which is placed rotatably in adapter 39.

Nut 41 is mounted fixedly on sleeve 40, for instance by means of a threaded connection.

Hose connecting module 38 provides a rotary coupling between nozzle 1 and hose 42 which prevents twisting of the hose. Twisting of the hose is undesirable because it results in loops in the hose when the nozzle hangs in the holder on the pump. In addition, lateral forces occur on a twisted hose during filling, which is inconvenient. The dimensions of nut 41 can of course be adapted to any type of hose.

Figure 13:
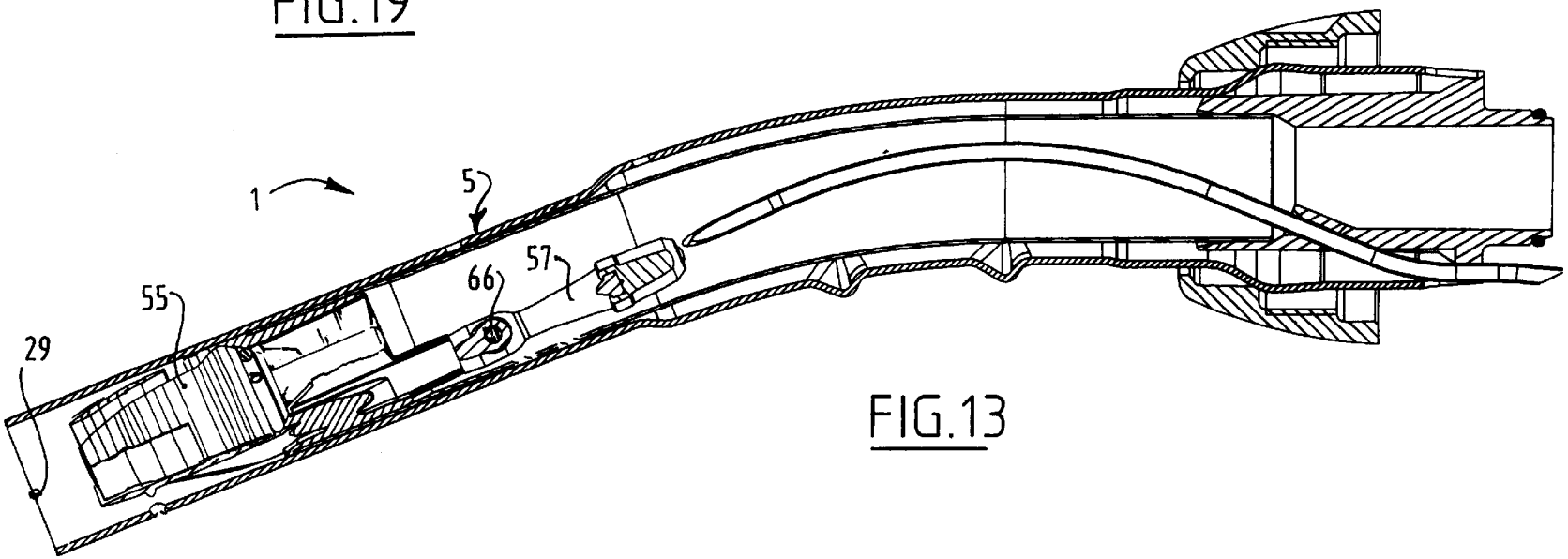
FIG. 13 shows a longitudinal section of an alternative preferred embodiment of a spout of a fluid dispensing nozzle.

FIG. 13 shows a longitudinal section through the spout 5 of an alternative preferred embodiment of a fluid dispensing nozzle 1 according to the invention. Close to the output end 29 of spout 5 is arranged an alternative preferred embodiment of an end valve comprising an end valve body 55 and an end valve seat 51. Situated further along in spout 5 is a fluid or venturi channel 57 and alternative level detection means.

Figure 14:
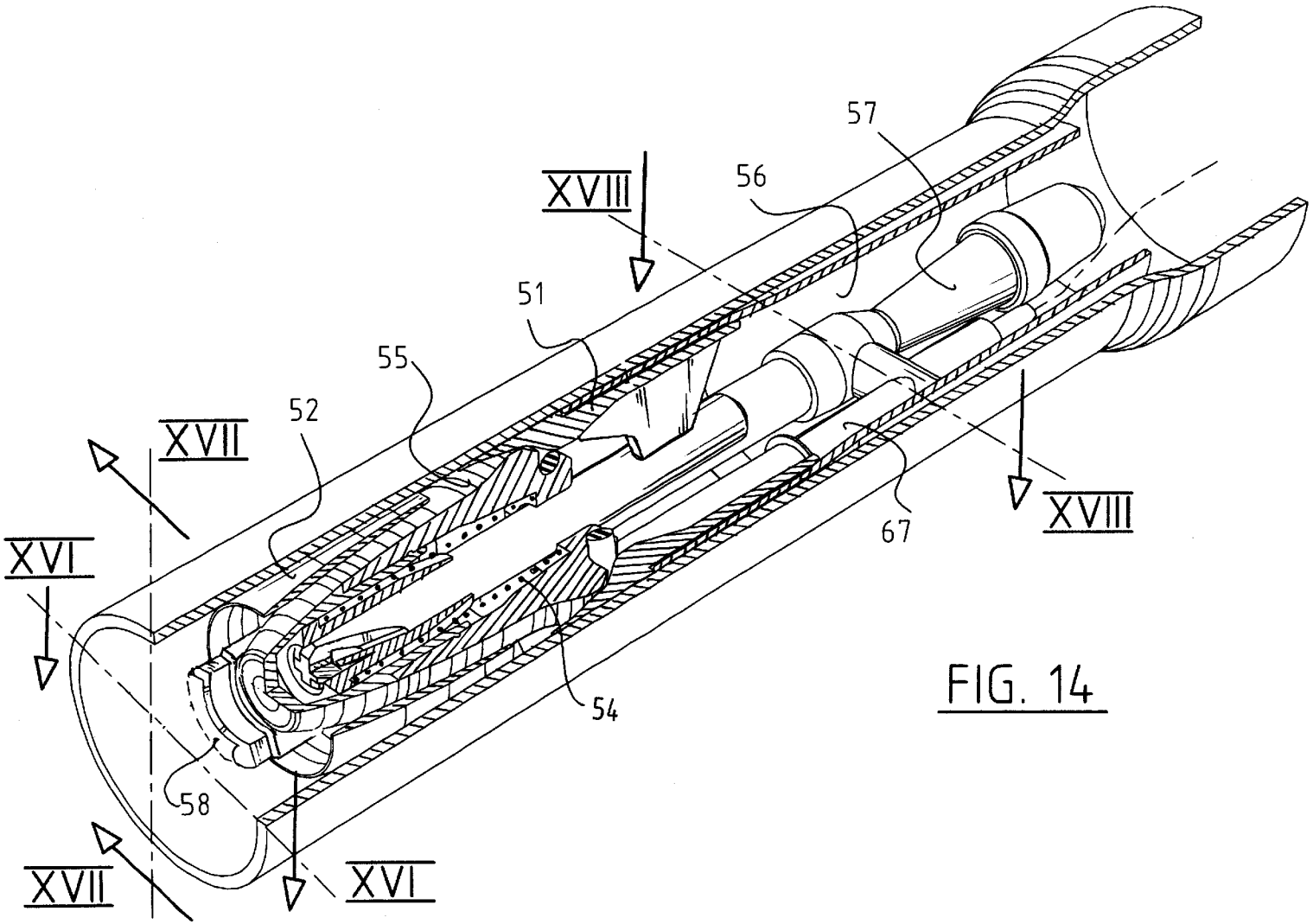
FIG. 14 shows in partly cut-away schematic view the half of the spout of FIG. 13 provided with the output end.

FIG. 14 shows the half of the spout provided with the output end in a partly cut-away schematic view. It can be seen clearly that a separate fluid channel 57 is arranged in through-flow channel 56. Fluid channel 57 runs at least partially along the end valve and has an outlet 58. Fluid channel 57 is referred to in the following as venturi channel. Venturi channel 57 consists partly of a pipe-shaped part which is fixed to the end valve, preferably to the seat 51 thereof. The pipe-shaped part narrows in a first portion in the direction of the output end of the spout. In a second portion connecting onto the first portion the venturi channel widens in the direction of the output end. The second portion of the venturi channel consists partly of a recess in the outer wall of the end valve, in this embodiment in the outer wall of end valve seat 51, and is partly formed by the inner wall of spout 5. Both the first and second portions of the venturi channel are approximately cone-shaped. The cone shape is partly compressed in the second portion, which results in a banana-shaped cross-section. This can be seen clearly at the output end. This form of the venturi channel is found in practice to contribute to a smooth flow of the fluid. Wings 52 are arranged on end valve body 55 to enhance a smooth flow of the fluid in the spout.

Figure 15:
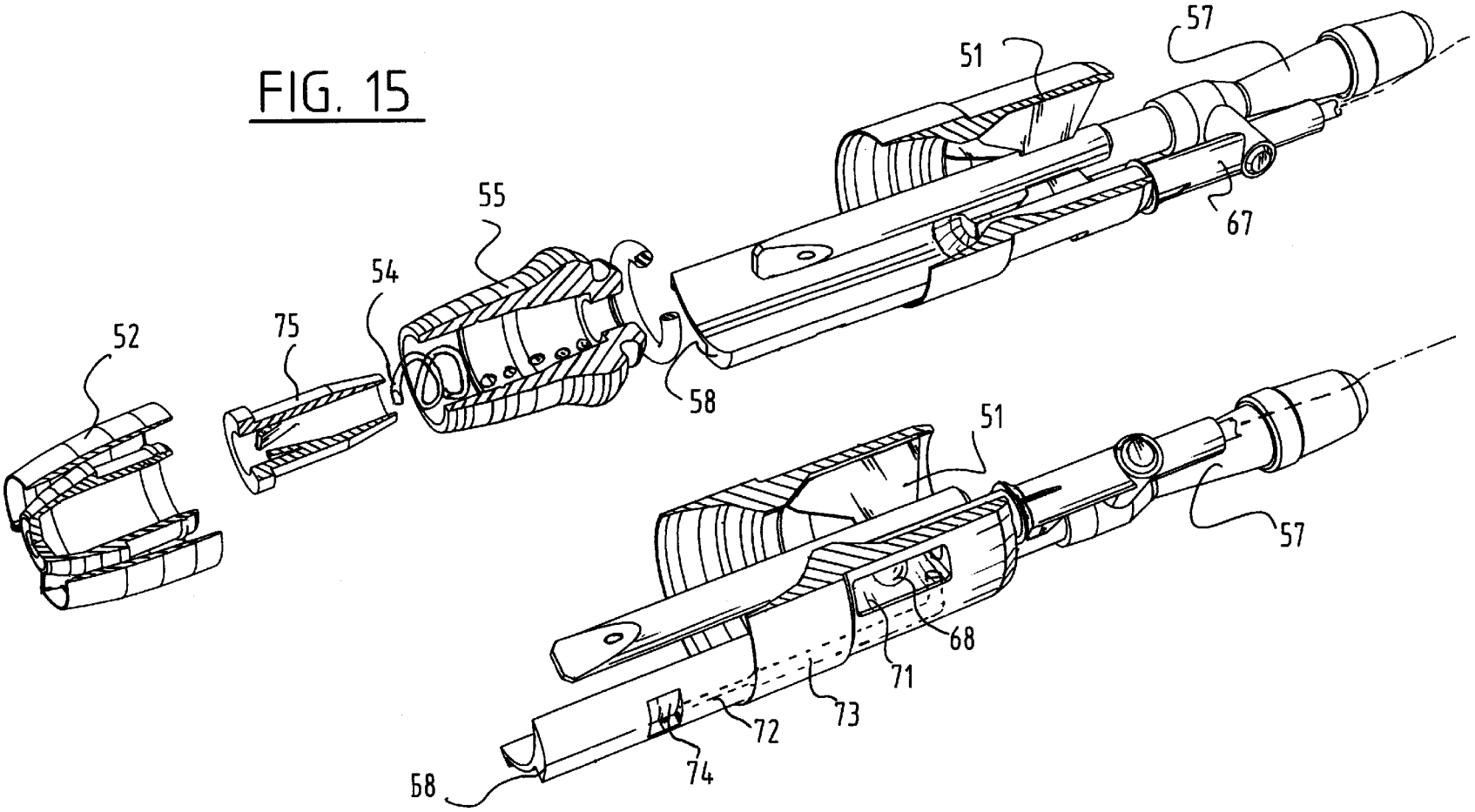
FIG. 15 shows the end valve of FIG. 14 with exploded parts in two different positions.

By way of elucidation FIG. 15 shows the end valve in exploded view. The end valve is shown in two positions, wherein the bottom position is rotated approximately 50° on the longitudinal axis relative to the top position.

Figures 16, 17, 18:
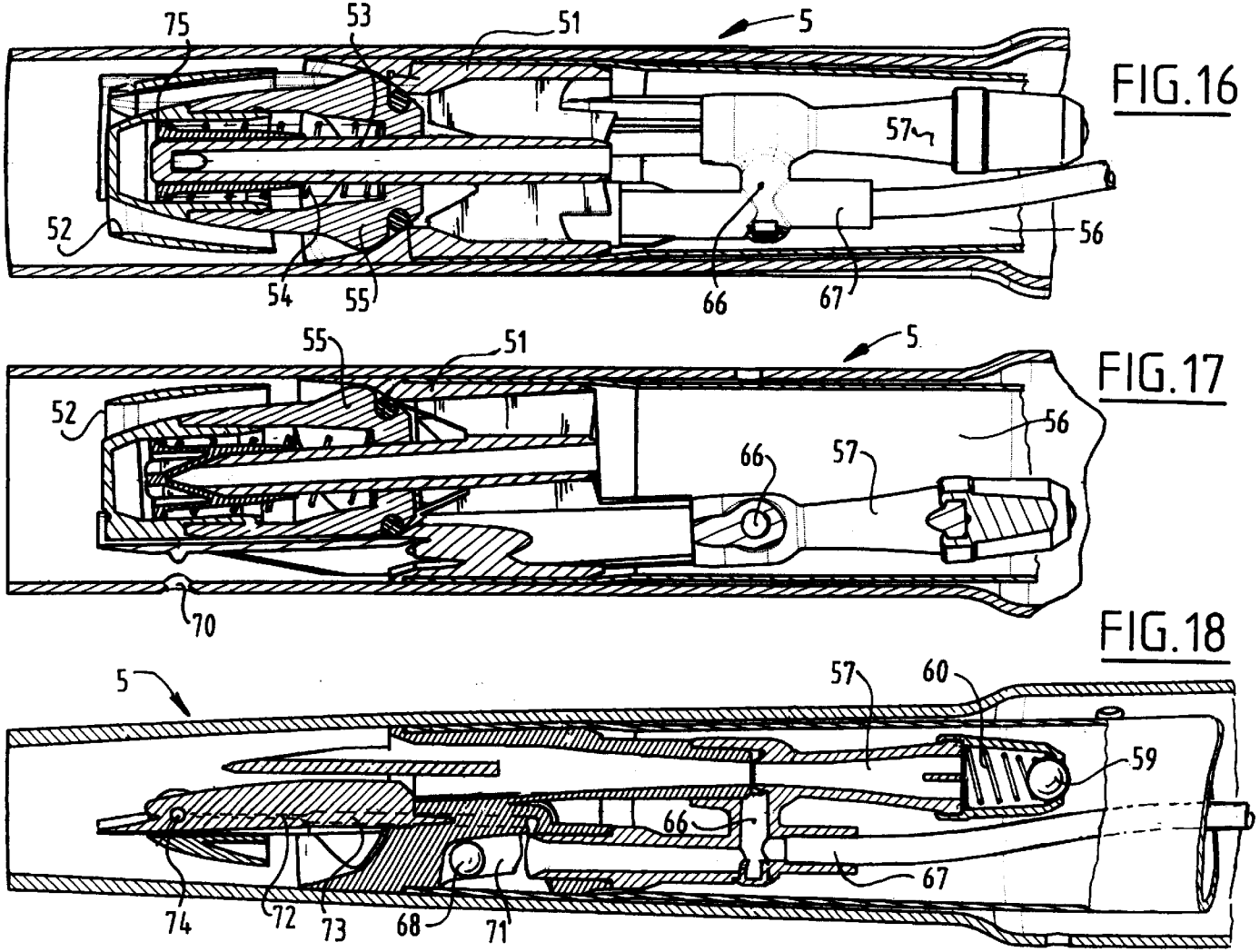
FIG. 16 is a top view of a part of the spout partly in cross-section along the center line of the end valve rod and along the line XVI—XVI in FIG. 14.
FIG. 17 shows in side view a longitudinal section through the spout of the foregoing figures at the position of the end valve.
FIG. 18 shows a longitudinal section in the same view as FIG. 16, but now at the position of the venturi along the line XVIII—XVIII of FIG. 14, at an angle of approximately 3° relative to the center line of the spout.

FIG. 16 shows a top view, partly in section, of a part of the spout along the center line of the end valve rod and along the line XVI—XVI in FIG. 14. In the end valve is arranged a spring 54 which on one side engages on end valve rod 53 via spring seat 75 and on the other side, on end valve body 55 itself. Using this spring the end valve is biased in the closed position. When the fluid pressure in through-flow channel 56 is sufficiently high, preferably 250–300 millibar, end valve 55 will then move to the open position.

FIG. 17 shows in side view a longitudinal section through spout 5 at the position of the end valve. The construction of end valve body 55 is such that the center line through the outer contour of end valve body 55 in all positions of the end valve runs parallel to the center line through spout 5. In the opened position of the end valve both center lines coincide. The center line through the outer contour of end valve body 55 differs from the "internal" center line which coincides with the center line of end valve rod 53 and lies at an angle of approximately 3° to the outer contour center line. In the shown closed position of the end valve the internal center line through end valve body 55 therefore also lies at an angle of approximately 3° to the center line through spout 5. The limited space available close to output end 29 is hereby utilized economically. In the opened position end valve body 55 is situated approximately in the middle of through-flow channel 56. A smooth outflow of the fluid around end valve body 55 is created in this way, thus resulting in a favorable fluid flow leaving outlet opening 29.

Figure 19:
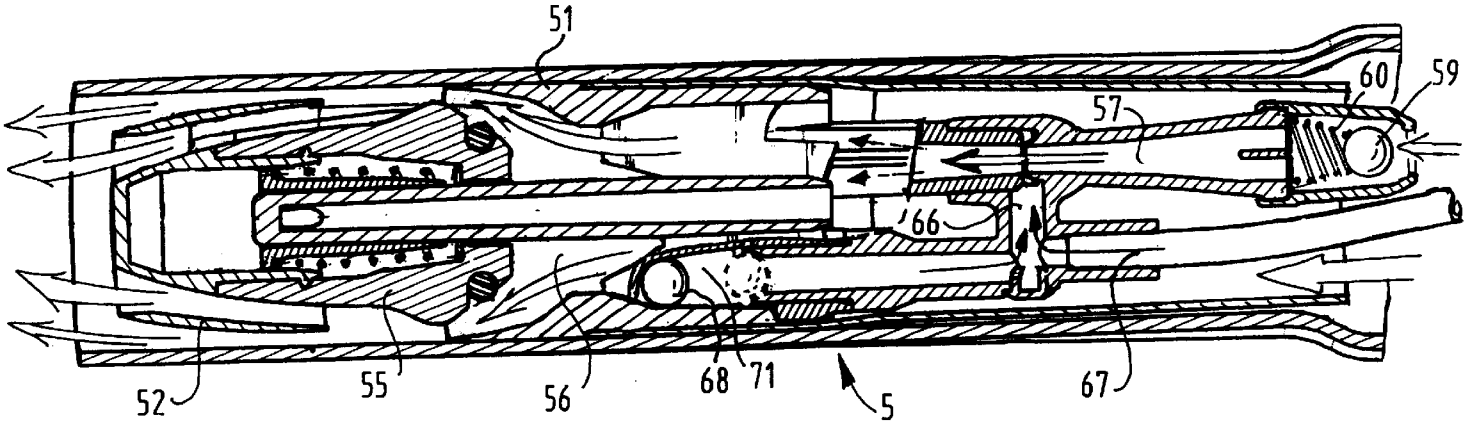
FIG. 19 shows the spout of FIG. 16 with all components in cross-section in the opened position of the end valve and the venturi channel

FIG. 18 shows a longitudinal section in the same view as FIG. 16, but now at the position of the venturi. It is noted for the sake of clarity that the curving progression results from the oblique section through spout 5. Venturi channel 57 is closable on one side by means of a ball-like closing body 59 which is biased counter to the flow direction by means of a spring 60. The bias is chosen such that venturi channel 57 is opened at a fluid pressure of preferably 150 to 200 millibar. Venturi channel 57 is therefore open preferably sooner than through-flow channel 56. The opened position of both components is shown in FIG. 19. The fluid flow is indicated in this figure with double arrows, while the gas or vapor flow is shown with single arrows. The venturi action is hereby visualized.

It is noted, perhaps unnecessarily, that the venturi operates briefly as follows: because fluid runs through venturi channel 57 underpressure is created in channel 66. Channel 66 is connected successively via chamber 71 and suction channel 73 to restriction 72 which in turn communicates with the outside via detection port 74 and the hole 70 in the outside of spout 5. When the tank is full of fluid, fluid as well as air will also enter restriction 72. This results in an increased underpressure which is detectable and used to close the main valve of the fluid dispensing nozzle via level detection channel 67 in the same way as described above for the other preferred embodiment.

The switch-off mechanism for the main valve is also set into operation when the fluid dispensing nozzle is moved in upward direction from an almost horizontal position of outlet opening 29. Ball 68 then rolls to its position shown in broken lines in which it blocks suction of air to suction channel 66. The underpressure in channel 66 hereby increases, as a result of which the switch-off mechanism of the main valve is set into operation. Chamber 71 in which ball 68 is situated preferably has a slightly sloping bottom such that ball 68 blocks the suction from an almost horizontal position of the spout, for instance minus 3°.

It will be apparent that in addition to the illustrated and described embodiment of a nozzle for fuel, many more other embodiments of the fluid dispensing nozzle can be realized according to the invention which fall within the scope of the appended claims.

What is claimed is:

1. A fluid dispensing nozzle which is connectable to a fluid reservoir for filling a tank with fluid, the fluid dispensing nozzle comprising:

a spout comprising an output end adapted to deliver fluid;

a through-flow channel in fluid communication with the spout;

a trigger adapted to operate at least one valve in the through-flow channel to open and/or close the through-flow channel;

an end valve movable between an open position wherein the end valve opens a through-flow opening for the fluid in the spout, and a closed position wherein the end valve closes the spout;

a venturi for co-action with a level detector adapted to detect the fluid level in the tank, wherein the end valve and the venturi are substantially arranged in the half of the spout provided with the output end; and a baffle element attached to the rear of the end valve as seen in a flow direction and adapted to open the end valve under the influence of the fluid flow.

2. The fluid dispensing nozzle of claim 1, wherein the spout is provided with a separate venturi channel for the fluid which runs along the end valve and forms part of the venturi.

3. The fluid dispensing nozzle of claim 2, wherein the venturi channel is formed at least partially by a recess in the outer wall of the end valve.

4. The fluid dispensing nozzle of claim 2, wherein the venturi channel is formed at least partially by a pipe-like part fixed to the end valve.

5. The fluid dispensing nozzle of claim 2, wherein a closing body is received in the venturi channel.

6. The fluid dispensing nozzle of claim 5, wherein biasing means are provided in the venturi channel for biasing the closing body in a direction opposed to the fluid flow.

7. The fluid dispensing nozzle of claim 6, wherein the biasing means are adapted such that during operation of the fluid dispensing nozzle, the venturi channel opens sooner than the through-flow opening of the spout closed by the end valve.

8. The fluid dispensing nozzle of claim 2, wherein the venturi channel widens in the direction of the output end.

9. The fluid dispensing nozzle of claim 8, wherein the venturi channel is at least partially cone-shaped.

10. The fluid dispensing nozzle of claim 8, wherein the cross-section of the venturi channel comprises a curvilinear shape.

11. The fluid dispensing nozzle of claim 1, wherein the end valve is provided with an end valve rod and wherein a center line through the end valve rod lies in one or more positions at an angle $\alpha>0$ to the center line through the spout.

12. The fluid dispensing nozzle of claim 1, wherein one or more wings are arranged on the end valve.

13. The fluid dispensing nozzle of claim 1, wherein the end valve and the venturi are arranged close to the output end of the spout.

14. The fluid dispensing nozzle of claim 1, wherein the end valve is provided with a seat, and wherein a form of the end valve is adapted to co-act with the seat and/or with an inner wall of the spout to form the venturi.

15. The fluid dispensing nozzle of claim 14, wherein the form of the end valve is substantially conical.

16. The fluid dispensing nozzle of claim 14, wherein the form of the end valve tapers conically toward both outer ends thereof.

17. The fluid dispensing nozzle of claim 1, further comprising a spring, wherein the end valve is movable counter to the action of the spring from the closed position to the open position in the direction of the output end, and wherein the spring has an at least partially degressive spring characteristic.

18. The fluid dispensing nozzle of claim 17, wherein the end valve is arranged movably on a shaft, and wherein the spring rests on one side against a stop arranged on the shaft and rests on the other side on the end valve.

19. The fluid dispensing nozzle of claim 18, wherein the spring is received in the end valve.

20. The fluid dispensing nozzle of claim 1, comprising a level detector for detecting the fluid level in the tank, which level detector comprises a level detection channel which runs substantially parallel to the through-flow channel, and wherein a closing body received in the level detection channel is adapted to close the level detection channel when fluid is detected.

21. The fluid dispensing nozzle of claim 20, wherein the closing body is adapted to be carried along by fluid flow to an upstream position in which the closing body substantially closes the level detection channel.

22. The fluid dispensing nozzle of claim 20, wherein the closing body is ball-shaped.

23. The fluid dispensing nozzle of claim 1, comprising a position detector which is in communication with the at least one valve and adapted to close the through-flow channel on detection of an approximately horizontal position of the fluid dispensing nozzle, wherein the position detector is arranged close to the output end of the spout.

24. The fluid dispensing nozzle of claim 1, wherein the fluid dispensing nozzle is a nozzle for filling a tank with fuel.

* * * * *

UNITED STATES PATENT AND TRADEMARK OFFICE

CERTIFICATE OF CORRECTION

PATENT NO. : 6,311,742 B1
DATED : November 6, 2001
INVENTOR(S) : Nusen et al.

It is certified that error appears in the above-identified patent and that said Letters Patent is hereby corrected as shown below:

Column 8,
Line 60, after the words "end valve" insert -- movably attached to a half of the spout provided with the output end such that the end valve is --.
Line 63, after the words "the spout;" insert -- and --.

Column 8 through column 9,
Line 67 through line 3, delete "; and a baffle element attached to the rear of the end valve as seen in a flow direction and adapted to open the end valve under the unfluence of the fluid flow".

Column 9,
Line 8, change "claim 2" to -- claim 1 --; and change "wherein the" to -- wherein a --.

Column 10,
Line 41, insert the following claims:

-- 25. The fluid dispensing nozzle of claim 1, further comprising an element arranged on the rear of the end valve as seen in a flow direction and adapted to selectively open end valve. --

-- 26. The fluid dispensing nozzle of claim 25, wherein the element comprises a baffle element. --

-- 27. A fluid dispensing nozzle which is connectable to a fluid reservoir for filling a tank with fluid, the fluid dispensing nozzle comprising:

a spout comprising an output end adapted to deliver fluid;

a through-flow channel in fluid communication with the spout;

a trigger adapted to operate at least one valve in the through-flow channel to open and/or close the through-flow channel;

an end valve movable between an open position wherein the end valve opens a through-flow opening for the fluid in the spout, and a closed position wherein the end valve closes the spout;

a venturi for co-action with a level detector adapted to detect the fluid level in the tank, wherein the end valve and the venturi are substantially arranged in a half of the spout provided with the output end, wherein the spout is provided with a separate venturi channel for the fluid which runs along the end valve and forms part of the venturi, and a closing body received in the venturi channel; and PATENT NO. : 6,311,742 B1
DATED : November 6, 2001
INVENTOR(S) : Nusen et al.

It is certified that error appears in the above-identified patent and that said Letters Patent is hereby corrected as shown below:

an element arranged on the rear of the end valve as seen in a flow direction and adapted to open the end valve under the influence of the fluid flow. --

-- 28. A fluid dispensing nozzle which is connectable to a fluid reservoir for filling a tank with fluid, the fluid dispensing nozzle comprising:

a spout comprising an output end adapted to deliver fluid;

a through-flow channel in fluid communication with the spout;

a trigger adapted to operate at least one valve in the through-flow channel to open and/or close the through-flow channel;

an end valve movable between an open position wherein the end valve opens a through-flow opening for the fluid in the spout, and a closed position wherein the end valve closes the spout, wherein the end valve is provided with an end valve rod and wherein a center line through the end valve rod lies in one or more positions at an angle $\alpha > 0$ to the center line through the spout;

a venturi for co-action with a level detector adapted to detect the fluid level in the tank, wherein the end valve and the venturi are substantially arranged in a half of the spout provided with the output end; and an element arranged on the rear of the end valve as seen in a flow direction and adapted to open the end valve under the influence of the fluid flow. --

-- 29. A fluid dispensing nozzle which is connectable to a fluid reservoir for filling a tank with fluid, the fluid dispensing nozzle comprising:

a spout comprising an output end adapted to deliver fluid;

a through-flow channel in fluid communication with the spout;

a trigger adapted to operate at least one valve in the through-flow channel to open and/or close the through-flow channel;

an end valve movable between an open position wherein the end valve opens a through-flow opening for the fluid in the spout, and a closed position wherein the end valve closes the spout, wherein one or more wings are arranged on the end valve;

It is certified that error appears in the above-identified patent and that said Letters Patent is hereby corrected as shown below:

a venturi for co-action with a level detector adapted to detect the fluid level in the tank, wherein the end valve and the venturi are substantially arranged in a half of the spout provided with the output end; and an element arranged on the rear of the end valve as seen in a flow direction and adapted to open the end valve under the influence of the fluid flow. --

-- 30. A fluid dispensing nozzle which is connectable to a fluid reservoir for filling a tank with fluid, the fluid dispensing nozzle comprising:

a spout comprising an output end adapted to deliver fluid;

a through-flow channel in fluid communication with the spout;

a trigger adapted to operate at least one valve in the through-flow channel to open and/or close the through-flow channel;

an end valve movable between an open position wherein the end valve opens a through-flow opening for the fluid in the spout, and a closed position wherein the end valve closes the spout, wherein the end valve is provided with a seat;

a venturi for co-action with a level detector adapted to detect the fluid level in the tank, wherein the end valve and the venturi are substantially arranged in a half of the spout provided with the output end, and wherein a form of the end valve is adapted to co-act with the seat and/or with an inner wall of the spout to form the venturi; and an element arranged on the rear of the end valve as seen in a flow direction and adapted to open the end valve under the influence of the fluid flow. --

-- 31. A fluid dispensing nozzle which is connectable to a fluid reservoir for filling a tank with fluid, the fluid dispensing nozzle comprising:

a spout comprising an output end adapted to deliver fluid;

a through-flow channel in fluid communication with the spout;

a trigger adapted to operate at least one valve in the through-flow channel to open and/or close the through-flow channel;

It is certified that error appears in the above-identified patent and that said Letters Patent is hereby corrected as shown below:

an end valve movable between an open position wherein the end valve opens a through-flow opening for the fluid in the spout, and a closed position wherein the end valve closes the spout;

a spring, wherein the end valve is movable counter to the action of the spring from the closed position to the open position in the direction of the output end, and wherein the spring has an at lease partially degressive spring characteristic;

a venturi for co-action with a level detector adapted to detect the fluid level in the tank, wherein the end valve and the venturi are substantially arranged in a half of the spout provided with the output end; and an element arranged on the rear of the end valve as seen in a flow direction and adapted to open the end valve under the influence of the fluid flow. --

-- 32. A fluid dispensing nozzle which is connectable to a fluid reservoir for filling a tank with fluid, the fluid dispensing nozzle comprising:

a spout comprising an output end adapted to deliver fluid;

a through-flow channel in fluid communication with the spout;

a trigger adapted to operate at least one valve in the through-flow channel to open and/or close the through-flow channel;

an end valve movable between an open position wherein the end valve opens a through-flow opening for the fluid in the spout, and a closed position wherein the end valve closes the spout;

a level detector for detecting the fluid level in the tank, which level detector comprises a level detection channel which runs substantially parallel to the through-flow channel, and wherein a closing body received in the level detection channel is adapted to close the level detection channel when fluid is detected;

a venturi for co-action with the level detector, wherein the end valve and the venturi are substantially arranged in a half of the spout provided with the output end; and an element arranged on the rear of the end valve as seen in a flow direction and adapted to open the end valve under the influence of the fluid flow. --

UNITED STATES PATENT AND TRADEMARK OFFICE

CERTIFICATE OF CORRECTION

PATENT NO. : 6,311,742 B1
DATED : November 6, 2001
INVENTOR(S) : Nusen et al.

It is certified that error appears in the above-identified patent and that said Letters Patent is hereby corrected as shown below:

-- 33. A fluid dispensing nozzle which is connectable to a fluid reservoir for filling a tank with fluid, the fluid dispensing nozzle comprising:

a spout comprising an output end adapted to deliver fluid;

a through-flow channel in fluid communication with the spout;

a trigger adapted to operate at least one valve in the through-flow channel to open and/or close the through-flow channel;

a position detector which is in communication with the at least one valve and adapted to close the through-flow channel on detection of an approximately horizontal position of the fluid dispensing nozzle, wherein the position detector is arranged close to the output end of the spout;

an end valve movable between an open position wherein the end valve opens a through-flow opening for the fluid in the spout, and a closed position wherein the end valve closes the spout;

a venturi for co-action with a level detector adapted to detect the fluid level in the tank, wherein the end valve and the venturi are substantially arranged in a half of the spout provided with the output end; and an element arranged on the rear of the end valve as seen in a flow direction and adapted to open the end valve under the influence of the fluid flow. --

Signed and Sealed this

Twenty-first Day of May, 2002

*Attest:*

*Attesting Officer*

JAMES E. ROGAN
*Director of the United States Patent and Trademark Office*